US011131948B2

(12) United States Patent
Ochi et al.

(10) Patent No.: US 11,131,948 B2
(45) Date of Patent: Sep. 28, 2021

(54) LIQUID APPLYING DEVICE FOR FIXING BELT

(71) Applicant: FUJIFILM Business Innovation Corp., Tokyo (JP)

(72) Inventors: Takashi Ochi, Kanagawa (JP); Takashi Ohashi, Kanagawa (JP); Takashi Matsubara, Kanagawa (JP); Toshimasa Toyama, Kanagawa (JP); Noboru Hirakawa, Kanagawa (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 0 days.

(21) Appl. No.: 16/859,382

(22) Filed: Apr. 27, 2020

(65) Prior Publication Data

US 2021/0048768 A1 Feb. 18, 2021

(30) Foreign Application Priority Data

Aug. 13, 2019 (JP) ..... JP2019-148562

(51) Int. Cl.
*G03G 15/20* (2006.01)

(52) U.S. Cl.
CPC ..... *G03G 15/2025* (2013.01); *G03G 15/2053* (2013.01); *G03G 15/2064* (2013.01)

(58) Field of Classification Search
CPC ..... G03G 2215/2035; G03G 15/2053; G03G 15/2025; G03G 15/2064
See application file for complete search history.

(56) References Cited

U.S. PATENT DOCUMENTS

2004/0240915 A1* 12/2004 Nakayama ..... G03G 21/0017 399/345
2009/0035034 A1* 2/2009 Nagase ..... G03G 15/2025 399/329
2009/0279929 A1* 11/2009 Nagase ..... G03G 15/206 399/329
2012/0201558 A1* 8/2012 Watanabe ..... G03G 15/2039 399/69
2015/0198919 A1* 7/2015 Lee ..... G03G 15/2025 399/329
2016/0170347 A1* 6/2016 Matsu Bara ..... G03G 15/2053 399/329

FOREIGN PATENT DOCUMENTS

JP 2009-109697 A 5/2009

* cited by examiner

*Primary Examiner* — Walter L Lindsay, Jr.
*Assistant Examiner* — Jessica L Eley
(74) *Attorney, Agent, or Firm* — Sughrue Mion, PLLC

(57) ABSTRACT

A liquid applying device includes a circulation member, an impregnation member, and a support member. The circulation member is configured to circulate in a predetermined direction. The impregnation member is formed in a plate shape. The impregnation member is impregnated with a liquid. The impregnation member is in contact with the circulation member at an end portion thereof in a direction intersecting with a circulating direction of the circulation member so as to apply the liquid to the circulation member. The support member supports a portion including an end portion side of the impregnation member, at an opposite side of the circulation member in a state where the end portion of the impregnation member is in contact with the circulation member.

21 Claims, 6 Drawing Sheets

LIQUID APPLYING DEVICE FOR FIXING BELT

CROSS-REFERENCE TO RELATED APPLICATIONS

This application is based on and claims priority under 35 USC 119 from Japanese Patent Application No. 2019-148562 filed Aug. 13, 2019.

BACKGROUND

1. Technical Field

The present disclosure relates to a liquid applying device and a heating device.

2. Related Art

JP-A-2009-109697 discloses a fixing device that applies oil to an inner surface of a fixing belt by bringing an oil supply member attached to a support frame into contact with the inner surface of the fixing belt.

SUMMARY

Aspects of non-limiting embodiments of the present disclosure relate to a liquid applying device and a heating device that prevents a decrease in an amount of a liquid supplied to a circulation member as compared with a configuration in which a plate-shaped impregnation member is supported up to an intermediate portion thereof.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided a liquid applying device including a circulation member, an impregnation member, and a support member. The circulation member is configured to circulate in a predetermined direction. The impregnation member is formed in a plate shape. The impregnation member is impregnated with a liquid. The impregnation member that is in contact with the circulation member at an end portion thereof in a direction intersecting with a circulating direction of the circulation member so as to apply the liquid to the circulation member. The support member supports a portion including an end portion side of the impregnation member, at an opposite side of the circulation member in a state where the end portion of the impregnation member is in contact with the circulation member.

BRIEF DESCRIPTION OF THE DRAWINGS

Exemplary embodiment(s) of the present disclosure will be described in detail based on the following figures, wherein.

DETAILED DESCRIPTION

Figure 1:
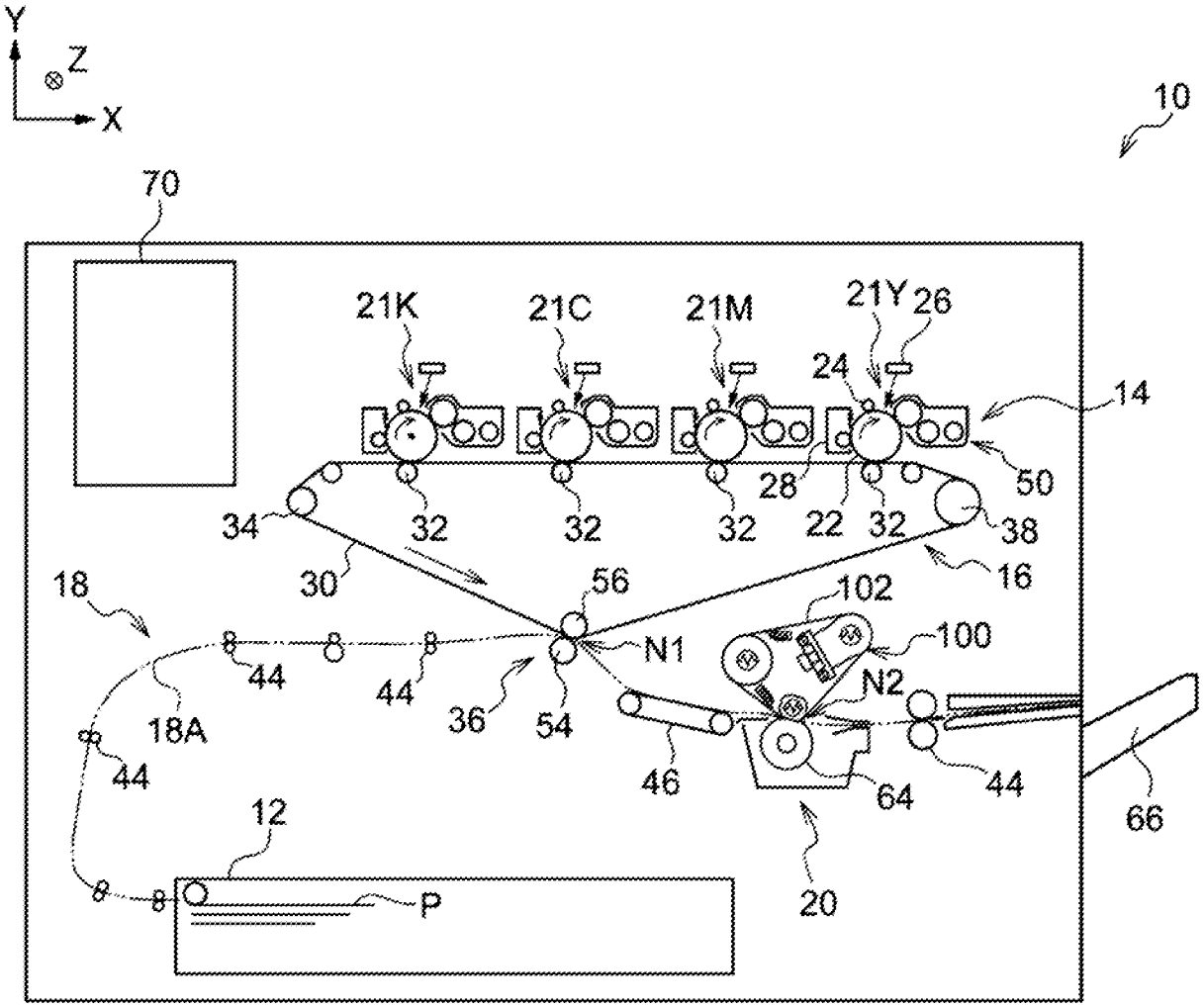
FIG. 1 is a configuration view illustrating an image forming apparatus provided with a fixing device including a liquid applying device according to a first exemplary embodiment.

Hereinafter, exemplary embodiments (hereinafter, referred to as "present exemplary embodiments") for implementing the present disclosure will be described. In the following description, a direction indicated by an arrow X in the drawings is defined as a device width direction, and a direction indicated by an arrow Y is defined as a device height direction. Further, a direction perpendicular to the device width direction and the device height direction, respectively, is defined as a device depth direction (a direction indicated by an arrow z).

First Exemplary Embodiment

FIG. 1 illustrates an example of an image forming apparatus 10 in which a fixing device 20 including a liquid applying device according to a first exemplary embodiment is disposed. First, the image forming apparatus (see FIG. 1) according to the present exemplary embodiment will be described. Subsequently, the fixing device 20 including the liquid applying device according to the first exemplary embodiment will be described.

[Overall Configuration of Image Forming Apparatus]

As illustrated in FIG. 1, the image forming apparatus 10 is of an electrophotographic type and includes a recording medium storage 12, a toner image forming unit 14, a transfer device 16, a recording medium transport device 18, the fixing device 20, and a controller 70.

The recording medium storage 12 has a function of storing a sheets P before images are formed. The sheets P are an example of recording media.

The toner image forming unit 14 has a function of performing each step of charging, exposing, and developing to form a toner image carried by an intermediate transfer belt 30 (to be described later) that constitutes the transfer device 16. The toner image forming unit 14 includes single-color units 21Y, 21M, 21C, and 21K that forms a toner image on each photoconductor 22 using, for example, toners of different colors (Y (yellow), M (magenta), C (cyan), and K (black)). Further, the toner image forming unit 14 is able to form toner images of plural colors, for example, according to image data. The photoconductor 22 is an example of an image carrier.

The single-color units 21Y, 21M, 21C, and 21K have the same configuration except for the color of the toner image formed by each single-color unit. Hereinafter, when it is not necessary to distinguish the single-color units 21Y, 21M, 21C, and 21K and components thereof, description will be made by omitting the alphabets (Y, M, C, and K) of the single-color units 21Y, 21M, 21C, and 21K. Each single-color unit 21 includes the photoconductor 22, a charging device 24, an exposing device 26, a developing device 50, and a cleaning device 28.

The transfer device 16 has a function of carrying toner images of the colors formed by the respective single-color units 21, and transferring the toner images onto the sheet P. The transfer device 16 includes the intermediate transfer belt 30, four transfer rollers 32, a driving roller 38, a secondary transfer unit 36, and a tension roller 34. The intermediate transfer belt 30 is of an endless type. The four transfer rollers 32 form a nip with each photoconductor 22 with the intermediate transfer belt 30 interposed therebetween, respectively. The intermediate transfer belt 30 is circularly moved by the driving roller 38 in a direction indicated by an arrow. In the present exemplary embodiment, as an example, the single-color units 21Y, 21M, 21C, and 21K are disposed in this order from the upstream side to the downstream side in the circular moving direction of the intermediate transfer belt 30. Therefore, the toner image on the photoconductor 22 formed by the single-color units 21Y, 21M, 21C, and 21K is transferred in a superimposed manner on the intermediate transfer belt 30 by the transfer roller 32.

The secondary transfer unit 36 includes a transfer roller 54 that is in contact with a surface of the intermediate transfer belt 30 on which the toner image is carried, and an opposing roller 56 disposed to face the transfer roller 54 with the intermediate transfer belt 30 interposed therebetween. In the secondary transfer unit 36, the toner images of the colors carried on the intermediate transfer belt 30 is transferred to the transported sheet P. Here, the toner image forming unit 14 and the transfer device 16 are an example of the image forming unit.

The recording medium transport device 18 has a function of transporting the sheet P such that the sheet P passes through a nip N1 of the secondary transfer unit 36 and a nip N2 of the fixing device 20. The recording medium transport device 18 includes plural transport rollers 44 and a transport belt 46. Here, the transport rollers 44 and the transport belt 46 are an example of a transport unit. The transport rollers 44 include a pair of rollers disposed in a state of being in contact with each other. The transport rollers 44 are configured to transport the sheet P stored in the recording medium storage 12 along a transport path 18A.

The transport belt 46 has a configuration in which an endless type belt is wound onto a pair of rollers that are spaced apart from each other. The transport belt 46 is disposed on downstream of the secondary transfer unit 36 and upstream of the fixing device 20 in the transport direction of the sheet P. The transport belt 46 is configured to transport the sheet P to which the toner image is transferred by the secondary transfer unit 36 to the fixing device 20 along the transport path 18A.

The fixing device 20 has a function of fixing the toner image transferred (secondarily transferred) to the sheet P by the transfer device 16 at the nip N2. The fixing device 20 includes a fixing belt module 100 having a fixing belt 102 that circularly moves, and a pressure roller 64 in contact with an outer surface of the fixing belt 102. The fixing belt is an example of a circulation member. The pressure roller 64 is an example of a rotating body. The fixing belt 102 is an endless type belt. The toner image on the sheet P is fixed by heating and pressurizing, by transporting the sheet P to the nip N2 between the fixing belt 102 and the pressure roller 64. The fixing device 20 will be described later.

The controller 70 has a function of controlling each component of the image forming apparatus 10. For example, the controller 70 is configured to control (that is, to cause each component to perform each operation) components of the image forming apparatus 10, according to job data received from an external device (not illustrated). Here, the job data includes image data (image information) that forms a toner image in each single-color unit 21, and other data necessary for an image forming operation.

[Operation of Image Forming Apparatus]

Subsequently, an operation of the image forming apparatus 10 will be described.

The controller 70 that receives the job data from an external device (not illustrated) operates the toner image forming unit 14, the transfer device 16, the recording medium transport device 18, and the fixing device 20. In the toner image forming unit 14, each photoconductor 22 is charged by each charging device 24, each photoconductor 22 is exposed by each exposing device 26 to form an electrostatic latent image, and then, the electrostatic latent image of each photoconductor 22 is developed as a toner image by each developing device 50. As a result, each toner image is formed on each photoconductor 22.

Subsequently, a voltage (primary transfer voltage) is applied from a power supply (not illustrated) to each transfer roller 32. Further, the driving roller 38 driven by a driving source (not illustrated) circulates the intermediate transfer belt 30 in a direction indicated by an arrow. As a result, the toner images of the colors are primarily transferred on the intermediate transfer belt 30 in a superimposed manner.

Furthermore, the recording medium transport device 18 feeds the sheet P to the nip N1 at the timing when the toner images of the colors carried on the circulating intermediate transfer belt 30 reach the nip N1. In the secondary transfer unit 36, the toner images of the colors are secondarily transferred to the sheet P passing through the nip N1, by applying a voltage (secondary transfer voltage) from a power supply (not illustrated) to a power supply roller (not illustrated) that is in contact with an outer periphery of the opposing roller 56.

Subsequently, the recording medium transport device 18 feeds the sheet P to which the toner images of the colors are secondarily transferred to the nip N2. As a result, an image is formed on the sheet P by fixing the toner images of the colors to the sheet P passing through the nip N2, by the fixing device 20. After that, the sheet P is discharged to a discharge unit 66 by the transport rollers 44.

[Fixing Device]

Subsequently, the fixing device 20 will be described.

Figure 2:
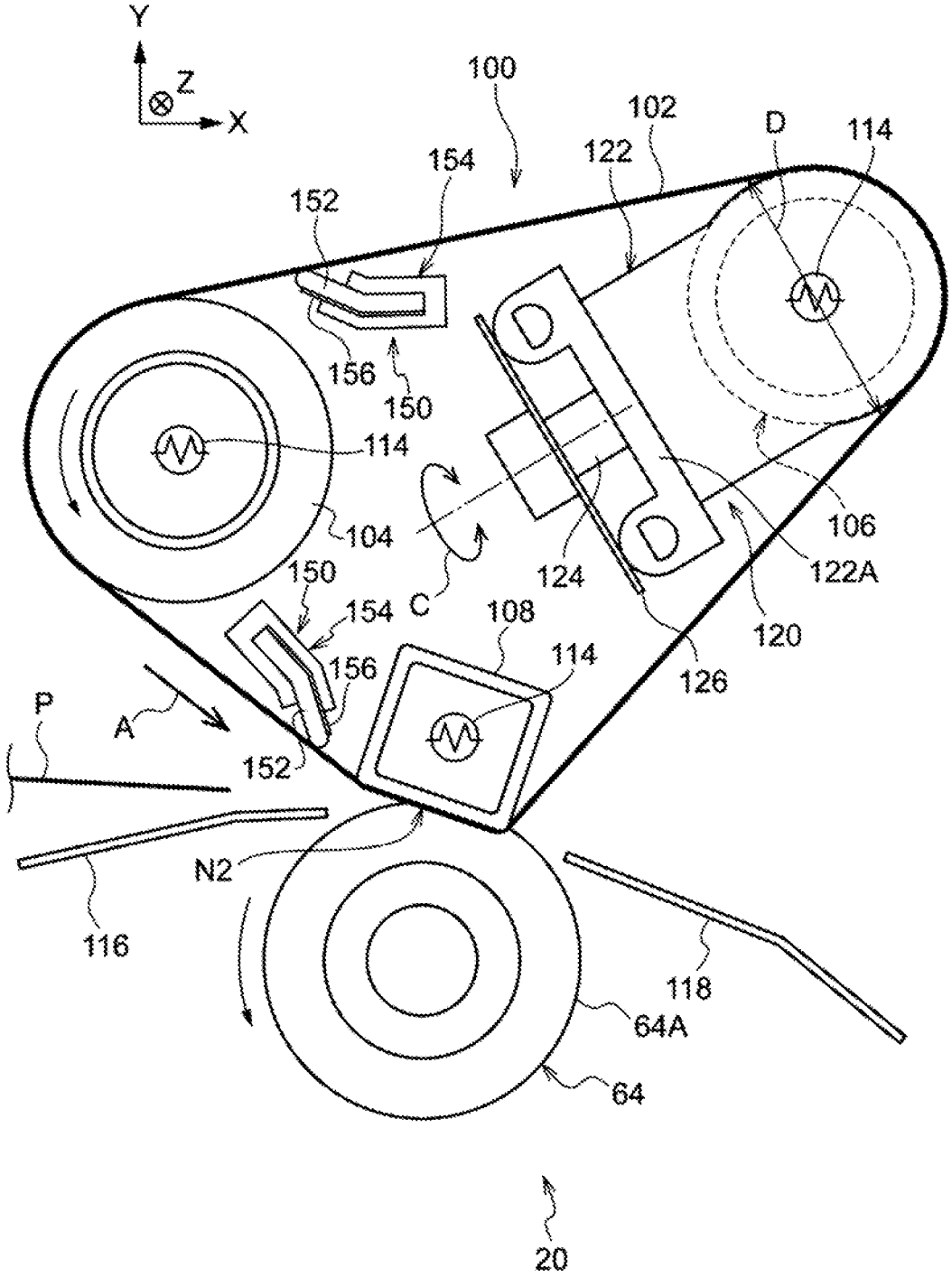
FIG. 2 is a cross-sectional view illustrating the fixing device including the liquid applying device according to the first exemplary embodiment.

FIG. 2 is a cross-sectional view illustrating the fixing device 20. As illustrated in FIG. 2, the fixing device 20 includes the fixing belt module 100, and the pressure roller 64 that is pressed against the fixing belt module 100 as described above. The fixing belt module 100 includes the fixing belt 102 that circularly moves in a direction of an arrow A, a stretch roller 104 that stretches the fixing belt 102 from inside the fixing belt 102, and a steering roller 106. Further, the fixing belt module 100 includes a pressing unit 108 that forms the nip N2 by pressing the fixing belt 102 against the pressure roller 64. The pressing unit 108 is an example of a nip forming unit. The steering roller 106 is disposed upstream of the stretch roller 104 and downstream of the pressing unit 108, in the circular moving direction of the fixing belt 102.

Further, the fixing belt module 100 includes a steering mechanism 120 that controls an inclination of the steering roller 106. Furthermore, the fixing belt module 100 includes liquid applying devices 150 configured to apply oil to an inner surface of the fixing belt 102. The oil is an example of a liquid. The liquid applying devices 150 is disposed between the steering roller 106 and the stretch roller 104 and between the stretch roller 104 and the pressing unit 108, respectively.

The fixing device 20 is configured such that there is no member other than the liquid applying device 150 that is in contact with the fixing belt 102 between the steering roller 106 and the stretch roller 104. Further, the fixing device 20 is configured such that there is no member other than the liquid applying device 150 that is in contact with the fixing belt 102 between the stretch roller 104 and the pressing unit 108. Therefore, the temperature of the fixing belt 102 is prevented from being lowered as compared with a case where other members that come into contact with the fixing belt 102 are provided.

In the fixing device 20, the nip N2 is formed by pressing firmly a portion of an outer peripheral surface 64A of the pressure roller 64 from the side opposite to the pressing unit 108, against the outer peripheral surface of the fixing belt 102 that is in contact with the pressing unit 108. The nip N2 where the outer peripheral surface 64A of the pressure roller 64 and the fixing belt 102 are in contact with each other is a passage through which the sheet P on which the toner image is formed passes while being pressed and heated.

The sheet P entered into the nip N2 has a toner image formed surface on which a toner image is formed. However, in the present exemplary embodiment, the sheet P enters into the nip N2 in a state where the toner image formed surface faces upward in the drawing. Therefore, in the present exemplary embodiment, the toner image formed surface side of the sheet P is brought into contact with the fixing belt 102.

Further, in the present exemplary embodiment, the pressure roller 64 is rotatably driven by a motor (not illustrated), and thus, the fixing belt 102 is circularly moved by following the pressure roller 64. That is, the fixing belt 102 receives a driving force from the rotating pressure roller 64, and performs a circular movement (circulation movement) in the direction of the arrow A in the drawing.

The stretch roller 104 and the steering roller 106 are rotatably supported, and support the fixing belt 102 to be able to circularly move by being wound by the fixing belt 102, respectively, at positions separated from each other. The pressing unit 108 is disposed at a position facing the pressure roller 64 with the fixing belt 102 interposed therebetween, and presses firmly the fixing belt 102 against the pressure roller 64 without being rotated. In the present exemplary embodiment, the pressing unit 108 is configured as a rectangular-shaped pad. The pressure roller 64 has an elastically deformable layer on the outer peripheral surface side, and thus, the pressure roller 64 becomes concave at the nip N2 when being in contact with the pressing unit 108 with the fixing belt 102. In the present exemplary embodiment, the sheet P is sandwiched from both sides by the pressure roller 64 and the pressing unit 108, and pressure is applied to the sheet P.

A heater 114 is provided inside the stretch roller 104, the steering roller 106, and the pressing unit 108. The heater 114 is an example of a heating member. The heater 114 is implemented by, for example, a halogen heater. The stretch roller 104, the steering roller 106, and the pressing unit 108 are heated by heat of the heater 114, respectively. Then, the fixing belt 102 is heated by heat from the stretch roller 104, the steering roller 106, and the pressing unit 108.

The steering mechanism 120 has a function of displacing (that is, changing the inclination) the steering roller 106. The steering mechanism 120 includes a frame 122 that supports the steering roller 106 rotatably in the circumferential direction, a rotation shaft 124 that rotates the frame 122 in a direction of an arrow C, a support portion 126 that rotatably supports the rotation shaft 124. Although not illustrated, the steering mechanism 120 includes a cam that is in contact with one end portion side of the frame 122 in the width direction, and the one end portion side of the frame 122 in the width direction swings in a direction of an arrow D by rotation of the cam. Therefore, the inclination of the steering roller 106 is changed.

The steering roller 106 is inclined with respect to a state parallel to the stretch roller 104 by the steering mechanism 120, and accordingly, the fixing belt 102 moves in the width direction. Therefore, the position of the fixing belt 102 in the width direction of the steering roller 106 is adjusted, and thus, positional deviation of the fixing belt 102 in the width direction is prevented.

The fixing device 20 includes a first sheet guide member 116 that is disposed upstream of the nip N2 in the transport direction of the sheet P. The first sheet guide member 116 guides the sheet P transported to the nip N2. The first sheet guide member 116 supports the sheet P from below, and guides the sheet P to the nip N2. Further, the fixing device 20 includes a second sheet guide member 118 that is disposed downstream of the nip N2. The second sheet guide member 118 guides the sheet P transported from the nip N2 to the downstream side. The second sheet guide member 118 supports the sheet P from below, and guides the sheet P to the downstream side.

[Operation of Fixing Device]

Subsequently, an operation of the fixing device 20 will be described. The configuration and the effect of the liquid applying device 150 will be described later.

In the fixing device 20, the fixing belt 102 is stretched between the stretch roller 104 and the steering roller 106 and the pressing unit 108, and the fixing belt 102 is circularly moved in the direction of the arrow A by the rotation of the pressure roller 64. The heater 114 is provided in the stretch roller 104, the steering roller 106, and the pressing unit 108, respectively, and thus, the fixing belt 102 is heated by heating the stretch roller 104, the steering roller 106, and the pressing unit 108 by the heater 114. The sheet P on which the toner image is formed is transported to the nip N2 between the fixing belt 102 and the pressure roller 64. Therefore, the toner image formed on the sheet P is melted by heating and pressing, and the toner image is fixed on the sheet P.

[Liquid Applying Device]

Subsequently, the liquid applying device 150 provided in the fixing device 20 will be described.

Figure 3:
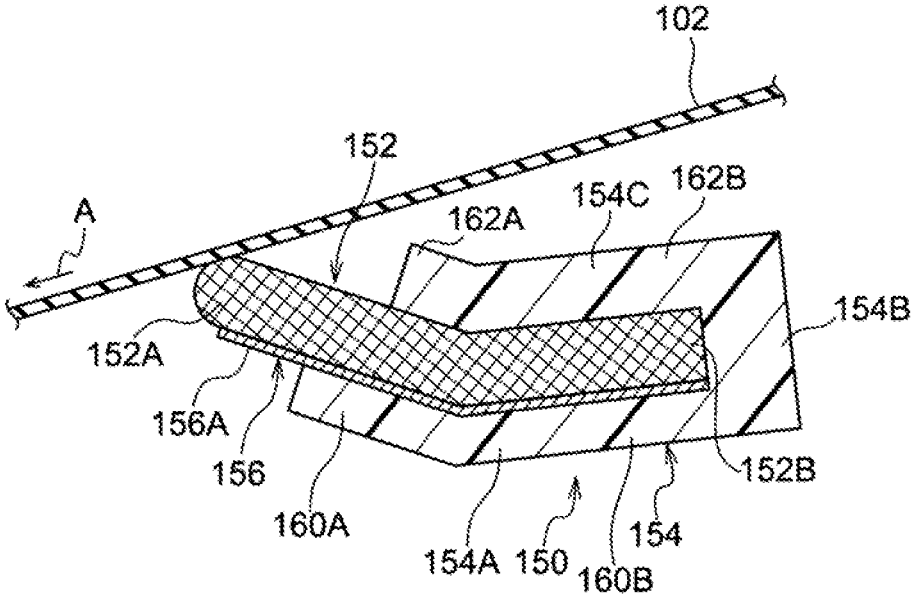
FIG. 3 is a cross-sectional view illustrating the liquid applying device according to the first exemplary embodiment.

The liquid applying device 150 is disposed inside the endless type fixing belt 102, and has a function of supplying oil to the inner surface of the fixing belt 102. The two liquid applying devices 150 provided in the fixing device 20 have the same configuration. As illustrated in FIG. 3, the liquid applying device 150 includes an impregnation member 152 impregnated with oil, and a housing 154 that holds the impregnation member 152. Further, the liquid applying device 150 includes a support member 156 that supports a portion including an end portion 152A side of the impregnation member 152 at a side opposite to the fixing belt 102.

The impregnation member 152 has a plate shape, and when viewed from the cross-sectional view illustrated in FIG. 3, the impregnation member 152 is in contact with the inner surface of the fixing belt 102 at the end portion 152A along the circular movement direction of the fixing belt 102. The impregnation member 152 is disposed along a direction (in the present exemplary embodiment, the width direction of the fixing belt 102) intersecting with the circulating direction of the fixing belt 102. That is, the end portion 152A of the impregnation member 152 in the direction intersecting with the longitudinal direction (that is, width direction) is in contact with the inner surface of the fixing belt 102. The impregnation member 152 is in contact with the inner surface of the fixing belt 102 obliquely with respect to the inner surface of the fixing belt 102, in a state of being supported by the housing 154 and the support member 156.

The impregnation member 152 is configured such that, for example, oil is impregnated to a non-woven fabric made of heat-resistant fibers. For example, a PTFE or the like is used as the heat-resistant fiber.

The housing 154 is formed in a U shape in the cross-sectional view illustrated in FIG. 3, and is disposed to surround a base end portion 152B side on a side opposite to the end portion 152A of the impregnation member 152. The housing 154 is disposed in an oblique direction with respect to the inner surface of the fixing belt 102. The housing 154 includes a plate-shaped rear side support piece 154A disposed on the side opposite to the fixing belt 102, and an intermediate portion 154B bent in a direction perpendicular to the end surface side of the base end portion 152B of the impregnation member 152 from the rear side support piece 154A. Further, the housing 154 includes a plate-shaped front side support piece 154C bent in the perpendicular direction from the intermediate portion 154B and disposed toward the fixing belt 102 side. A tip portion 160A of the rear side support piece 154A is bent in an obtuse angle direction with respect to a rear end portion 160B to approach the fixing belt 102 side. Further, a tip portion 162A of the front side support piece 154C is bent in an obtuse angle direction with respect to a rear end portion 162B to approach the fixing belt 102 side. When viewed in the cross-sectional view illustrated in FIG. 3, the length of the rear side support piece 154A is longer than the length of the front side support piece 154C. The housing 154 is mounted to a frame (not illustrated) fixed to the inside of the fixing belt 102.

As described above, the support member 156 supports the portion including the end portion 152A side of the impregnation member 152 at the side opposite to the fixing belt 102. Here, "supporting the portion including the end portion 152A side of the impregnation member 152" refers to supporting the portion corresponding to a thickness t of the impregnation member 152 with respect to the portion of the end portion 152A of the impregnation member 152 that is in contact with the fixing belt 102, by the support member 156.

The support member 156 is provided in the housing 154 to be elastically deformable. The support member 156 is configured to press the end portion 152A of the impregnation member 152 against the fixing belt 102 by applying pressure at the side opposite to the fixing belt 102, in an elastically deformed state. In the present exemplary embodiment, the support member 156 is implemented by a leaf spring disposed along the circulating direction of the fixing belt 102 in the cross-sectional view. The support member 156 is made of metal.

The support member 156 is mounted on the surface of the rear side support piece 154A on the fixing belt 102 side, and is bent at an intermediate portion of the support member 156 to form an obtuse angle according to the shape of the rear side support piece 154A. The tip portion 156A of the support member 156 protrudes toward the fixing belt 102 side from the tip portion 160A of the rear side support piece 154A, and the tip portion 156A of the support member 156 is elastically deformable. The tip portion 156A of the support member 156 is in contact with the surface of the end portion 152A of the impregnation member 152 on the side opposite to the fixing belt 102. The tip portion 156A of the support member 156 does not protrude from the end portion 152A of the impregnation member 152. The pressing direction in which the impregnation member 152 is pressed against the fixing belt 102 by the support member 156 is an oblique direction with respect to the inner surface of the fixing belt 102, and the end portion 152A of the impregnation member 152 and the tip portion 156A of the support member 156 are facing the downstream side in the circular moving direction of the fixing belt 102.

The support member 156 is disposed along the width direction of the fixing belt 102. The support member 156 may be implemented by a single member disposed along the width direction of the fixing belt 102, or may be implemented by plural members disposed side by side along the width direction of the fixing belt 102. In the present exemplary embodiment, plural support members 156 are disposed side by side along the width direction of the fixing belt 102.

A pressing force with which the end portion 152A of the impregnation member 152 is pressed against the fixing belt 102 by the support member 156 is different in the width direction of the fixing belt 102. In the present exemplary embodiment, the thickness of the support member 156 is larger at the end portions in the width direction of the fixing belt 102 than at the central portion in the width direction of the fixing belt 102. Therefore, the pressing force with which the end portion 152A of the impregnation member 152 is pressed against the fixing belt 102 by the support member 156 is stronger at the end portions in the width direction of the fixing belt 102 than at the central portion in the width direction of the fixing belt 102. The support member 156 may be implemented by, for example, partially overlapping two leaf springs in the width direction of the fixing belt 102, or may be an integral member such as a stepped plate.

[Operation and Effect]

Subsequently, operations and effect of the present exemplary embodiment will be described.

In the fixing device, when the non-rotating pressing unit is in contact with the inner surface of the fixing belt at the nip between the fixing belt and the pressure roller, sliding occurs between the inner surface of the fixing belt and the pressing unit. Therefore, the inner surface of the fixing belt is easily worn.

With regard to this aspect, the end portion 152A of the impregnation member 152 is in contact with the inner surface of the fixing belt 102, so that the liquid applying device 150 applies the oil to the inner surface of the fixing belt 102. Therefore, even when the non-rotating pressing unit 108 is in contact with the inner surface of the fixing belt 102 at the nip N2, wear of the fixing belt 102 is prevented by lowering the friction coefficient between the pressing unit 108 and the fixing belt 102 by the oil, compared to a case where oil is not applied. Further, even when the fixing belt 102 is worn, the end portion 152A of the impregnation member 152 is in contact with the inner surface of the fixing belt 102, so that abrasion powder attached to the fixing belt 102 is removed (that is, the inner surface of the fixing belt 102 is cleaned).

Here, a liquid applying device 300 according to Comparative Example 1 will be described using FIGS. 8 and 9.

Figure 8:
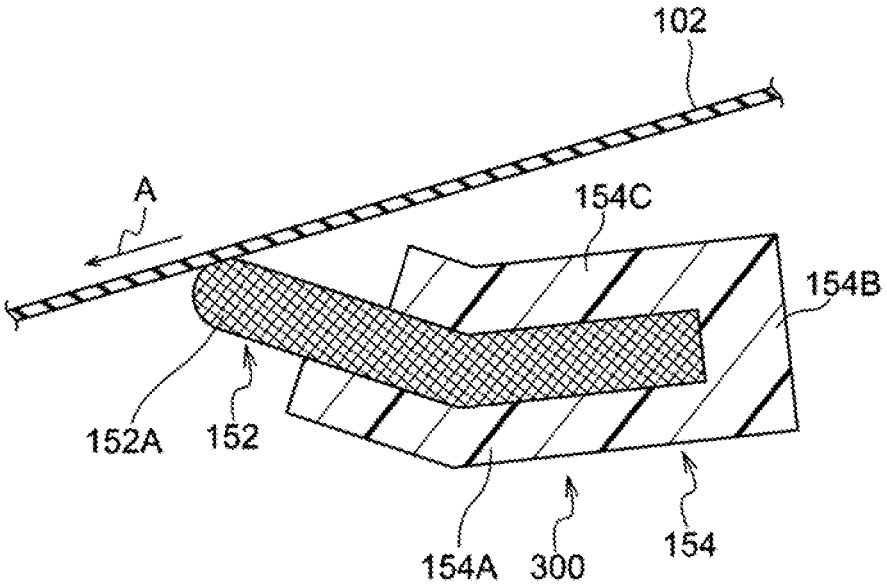
FIG. 8 is a cross-sectional view illustrating the liquid applying device according to Comparative Example 1.

As illustrated in FIG. 8, the liquid applying device 300 according to Comparative Example 1 includes the plated-shaped impregnation member 152 impregnated with oil, and the housing 154 that holds the impregnation member 152. The housing 154 includes the rear side support piece 154A disposed on the side opposite to the fixing belt 102, the intermediate portion 154B, and the front side support piece 154C disposed toward the fixing belt 102 side. The end portion 152A of the impregnation member 152 is in contact with the fixing belt 102 in a state where the impregnation member 152 is held in the housing 154. The liquid applying device 300 is not provided with a leaf spring that supports the end portion 152A side of the impregnation member 152.

Figure 9:
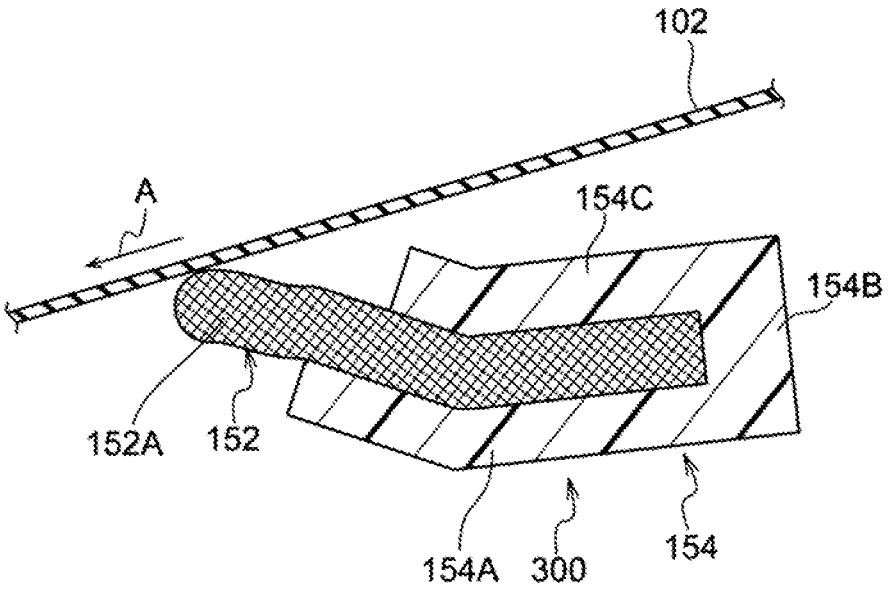
FIG. 9 is a cross-sectional view illustrating a state where the impregnation member being in contact with the fixing belt is deformed in the liquid applying device according to Comparative Example 1.

As illustrated in FIG. 9, in the liquid applying device 300, when the end portion 152A of the impregnation member 152 is continuously pressed against the fixing belt 102, due to the pressure caused by the reaction, the end portion 152A side (that is, a portion protruding from the rear side support piece 154A) of the impregnation member 152 is gradually plastically deformed. As a result, an amount of the oil supplied to the fixing belt 102 is changed when the impregnation member 152 is new and the impregnation member 152 is deformed over time, and thus, the sliding between the end portion 152A of the impregnation member 152 and the fixing belt 102 may be affected. When the plastic deformation of the end portion 152A of the impregnation member 152 is large, depending on cases, the pressing force with which the end portion 152A of the impregnation member 152 is pressed against the fixing belt 102 becomes too small, and the supply amount of the oil is decreased. As a result, torque of a motor for circularly moving the fixing belt 102 may be increased, or the wear of the inner surface of the fixing belt 102 may be accelerated.

With regard to this aspect, in the liquid applying device 150 according to the present exemplary embodiment, the portion including the end portion 152A side of the impregnation member 152 is supported at the side opposite to the fixing belt 102, by the support member 156. The support member 156 is implemented by a leaf spring, and presses the end portion 152A of the impregnation member 152 against the fixing belt 102 by applying pressure at the back side of the impregnation member 152. Therefore, the pressure in the direction in which the impregnation member 152 is pushed back is resisted by the reaction of the pressure of the end portion 152A of the impregnation member 152 pressing against the fixing belt 102, and thus, the state where the end portion 152A of the impregnation member 152 is pressed against the fixing belt 102 is maintained. As a result, the pressure of the end portion 152A of the impregnation member 152 pressing the fixing belt 102 is prevented from being changed over time by the support member 156.

In the above-described liquid applying device 150, as compared with the configuration in which the intermediate portion of the plate-shaped impregnation member is supported, the decrease in the amount of the oil supplied to the fixing belt 102 is prevented, and further, the increase of the torque of the motor for circularly moving the fixing belt 102 or the wear of the fixing belt 102 is prevented.

Further, in the liquid applying device 150, the liquid applied to the inner surface of the fixing belt 102 is oil. As a result, in the liquid applying device 150, as compared with a case where the liquid is water, the application of the oil to the fixing belt 102 is stabilized, and further, the abrasion powder attached to the fixing belt 102 is collected by the oil.

Further, in the liquid applying device 150, the support member 156 is configured to press the end portion 152A of the impregnation member 152 against the fixing belt 102 by applying pressure at the side opposite to the fixing belt 102, in an elastically deformed state. As a result, in the liquid applying device 150, as compared with a configuration in which the impregnation member is brought in contact with the circulation member without applying pressure, the decrease in the amount of the oil supplied to the fixing belt 102 is prevented.

Further, in the liquid applying device 150, the support member 156 is implemented by a leaf spring. As a result, in the liquid applying device 150, as compared with a case where the support member is implemented by plural coil springs, the function of preventing the deformation of the impregnation member 152 and the function of pressing the impregnation member 152 against the fixing belt 102 may be performed by one member.

Further, in the liquid applying device 150, a pressing force with which the end portion 152A of the impregnation member 152 is pressed against the fixing belt 102 by the support member 156 is different in the width direction of the fixing belt 102. As a result, in the liquid applying device 150, as compared with a configuration in which the pressing force with which the end portion of the impregnation member is pressed against the circulation member is constant in the width direction of the circulation member, the variation in the oil supply amount in the width direction of the fixing belt 102 is prevented.

Generally, in a liquid applying device, oil escapes to the outside of the fixing belt, and thus, the oil tends to be insufficient at the end portion sides of the fixing belt in the width direction. With regard to this aspect, the above-described liquid applying device 150 is configured such that the pressing force with which the end portion 152A of the impregnation member 152 is pressed against the fixing belt 102 by the support member 156 is stronger at the end portions in the width direction of the fixing belt 102 than that at the central portion in the width direction of the fixing belt 102. Therefore, the oil supply amount at the end portions in the width direction of the fixing belt 102 becomes larger than the oil supply amount at the central portion in the width direction of the fixing belt 102. As a result, in the liquid applying device 150, as compared with a configuration in which the pressing force with which the end portion of the impregnation member is pressed against the circulation member is weaker at the end portions in the width direction of the circulation member than that at the central portion in the width direction of the circulation member, the insufficiency of oil supply at the end portions in the width direction of the fixing belt 102 is prevented.

Further, in the liquid applying device 150, the thickness of the support member 156 is larger at the end portions in the width direction of the fixing belt 102 than at the central portion in the width direction of the fixing belt 102. As a result, in the liquid applying device 150, as compared with a configuration in which the thickness of the support member is thinner at the end portions in the width direction of the circulation member than that at the central portion in the width direction of the circulation member, the insufficiency of oil supply at the end portions in the width direction of the fixing belt 102 is prevented.

Further, in the liquid applying device 150, plural support members 156 are disposed in the width direction of the fixing belt 102. In the liquid applying device 150, as compared with a case where the support member is implemented by one member in the width direction of the circulation member, the pressing force with which the impregnation member 152 is pressed against the fixing belt 102 is easily changed in the width direction of the fixing belt 102.

Further, in the liquid applying device 150, the thickness of the support member 156 is different in the width direction of the fixing belt 102. As a result, in the liquid applying device 150, as compared with a case where the thickness of the support member is constant in the width direction of the circulation member, the pressing force with which the impregnation member 152 is pressed against the fixing belt 102 is easily set in the width direction of the fixing belt 102.

Further, in the fixing device 20 including the liquid applying device 150, as compared when including the liquid applying device in which the intermediate portion of the plate-shaped impregnation member is supported, the fluctuation of the torque of the motor that drives the fixing belt 102 is reduced.

Furthermore, in the image forming apparatus 10 including the liquid applying device 150, as compared with a case where the impregnation member is easily plastically deformed in a direction away from the circulation member by the heat of the circulation member, power consumption is decreased.

Second Exemplary Embodiment

Figure 4:
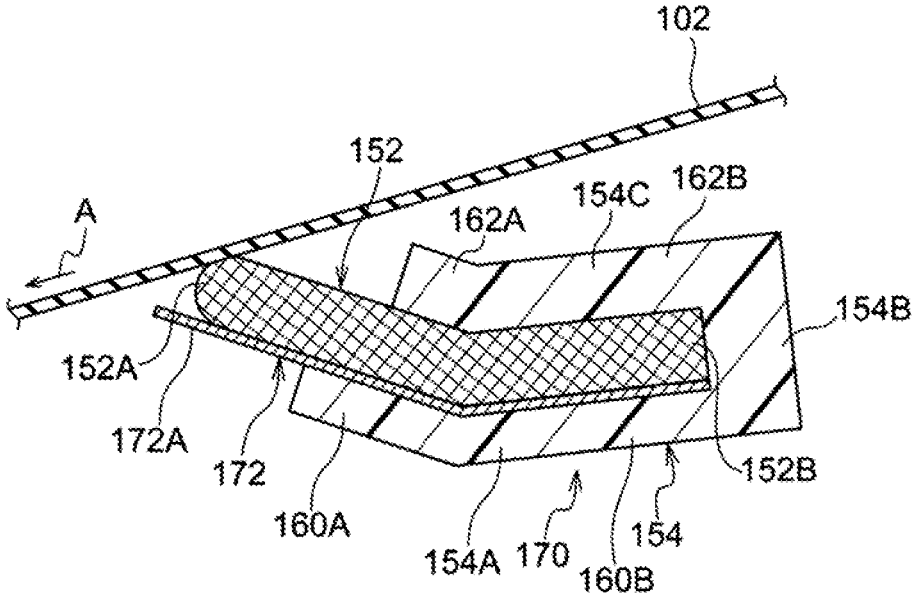
FIG. 4 is a cross-sectional view illustrating a liquid applying device according to a second exemplary embodiment.

FIG. 4 illustrates a liquid applying device according to a second exemplary embodiment. The same components as those in the first exemplary embodiment described above are denoted by the same reference numerals, and redundant explanations are omitted.

As illustrated in FIG. 4, a liquid applying device 170 includes the impregnation member 152, the housing 154, and a support member 172. The support member 172 is supported by the housing 154 to be elastically deformable. The support member 172 is configured to press the end portion 152A of the impregnation member 152 against the fixing belt 102 by applying pressure at the side opposite to the fixing belt 102, in an elastically deformed state. In the present exemplary embodiment, the support member 172 is implemented by a leaf spring disposed along the circulating direction of the fixing belt 102 in the cross-sectional view. The support member 172 is mounted on the surface of the rear side support piece 154A on the fixing belt 102 side, and is bent at an intermediate portion of the support member 156 according to the shape of the rear side support piece 154A.

A tip portion 172A side of the support member 172 protrudes toward the fixing belt 102 side from the tip portion 160A of the rear side support piece 154A. Furthermore, the tip portion 172A of the support member 172 extends in the circulating direction of the fixing belt 102 beyond the end portion 152A of the impregnation member 152. A pressing direction in which the impregnation member 152 is pressed against the fixing belt 102 by the support member 172 is oblique with respect to the inner surface of the fixing belt 102. The end portion 152A of the impregnation member 152 and the tip portion 172A of the support member 172 face the downstream side in the circular moving direction of the fixing belt 102.

The support member 172 is disposed along the width direction of the fixing belt 102. The support member 172 may be implemented by a single member disposed along the width direction of the fixing belt 102, or may be implemented by plural members disposed side by side along the width direction of the fixing belt 102. In the present exemplary embodiment, plural support members 172 are disposed side by side along the width direction of the fixing belt 102.

In addition to the operation and effects of the same configuration as the liquid applying device 150 according to the first exemplary embodiment, the above-described liquid applying device 170 has the following operation and effects.

In the liquid applying device 170, the tip portion 172A of the support member 172 extends in the circulating direction of the fixing belt 102 beyond the end portion 152A of the impregnation member 152. As a result, in the liquid applying device 170, as compared with a case where the end portion of the impregnation member extends in the circulating direction of the circulation member beyond the end portion of the support member, the deformation of the impregnation member 152 is prevented. Therefore, in the liquid applying device 170, as compared with a case where the end portion of the impregnation member extends in the circulating direction of the circulation member beyond the end portion of the support member, the decrease in the amount of the oil supplied to the fixing belt 102 is prevented, and further, the increase of the torque of the motor for circularly moving the fixing belt 102 or the wear of the fixing belt 102 is prevented.

Third Exemplary Embodiment

Figure 5:
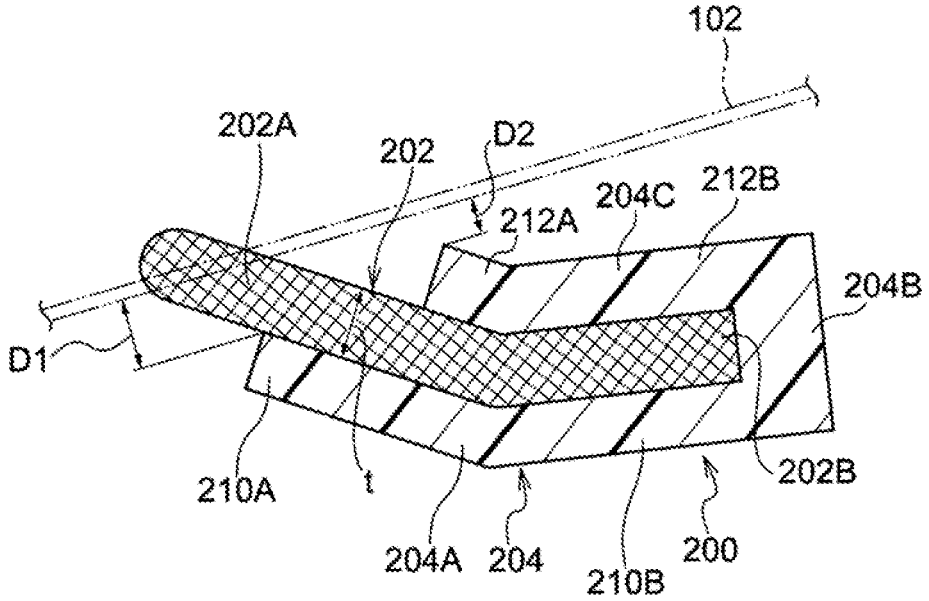
FIG. 5 is a cross-sectional view illustrating a liquid applying device according to a third exemplary embodiment in a state before an impregnation member is in contact with a fixing belt.
Figure 6:
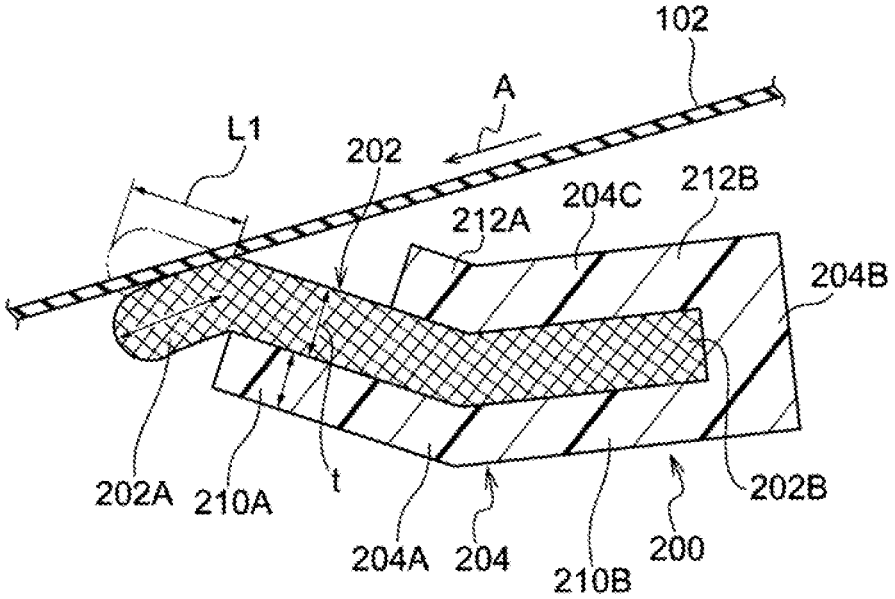
FIG. 6 is a cross-sectional view illustrating the liquid applying device according to the third exemplary embodiment in a state where the impregnation member is in contact with the fixing belt.

FIGS. 5 and 6 illustrate a liquid applying device according to a third exemplary embodiment. The same components as those in the first exemplary embodiment and the second exemplary embodiment described above are denoted by the same reference numerals, and redundant explanations are omitted.

As illustrated in FIGS. 5 and 6, a liquid applying device 200 includes a plate-shaped impregnation member 202 that applies oil to the fixing belt 102, and a support member 204 that supports the impregnation member 202. The oil is an example of a liquid. An end portion 202A of the impregnation member 202 is in contact with the inner surface of the fixing belt 102. The support member 204 supports a portion including the end portion 202A side of the impregnation member 202 at the side opposite to the fixing belt 102 in a state where the end portion 202A of the impregnation member 202 is in contact with the fixing belt 102.

The support member 204 is formed in a U shape in the cross section, and is disposed to surround a base end portion 202B side that is a portion of the impregnation member 202. The support member 204 includes a plate-shaped rear side support portion 204A that supports the impregnation member 202 on the side opposite to the fixing belt 102. Furthermore, the support member 204 includes an intermediate portion 204B that is bent at the end surface side of the base end portion 202B of the impregnation member 202 from the rear side support portion 204A, and a plate-shaped front side support portion 204C that is bent from the intermediate portion 204B and supports the fixing belt 102 side of the impregnation member 202.

A tip portion 210A of the rear side support portion 204A is bent with respect to a rear end portion 210B to approach the fixing belt 102 side. Further, a tip portion 212A of the front side support portion 204C is bent with respect to a rear end portion 212B to approach the fixing belt 102 side. The support member 204 is mounted to a frame (not illustrated) fixed to the inside of the fixing belt 102. In the present exemplary embodiment, the support member 204 is implemented by a sheet metal. The rear side support portion 204A is an example of a support portion, and the front side support portion 204C is an example of another support portion.

In a cross section illustrated in FIG. 5, the length of the rear side support portion 204A along the circulating direction of the fixing belt 102 is longer than the length of the front side support portion 204C along the circulating direction of the fixing belt 102.

The impregnation member 202 has the same configuration as that of the impregnation member 152 according to the first exemplary embodiment, and is impregnated with oil as an example of a liquid.

In the liquid applying device 200, the distance between an edge (a portion that is closest to the fixing belt 102) of the tip portion 210A of the rear side support portion 204A and the fixing belt 102 in the vertical direction of the fixing belt 102 is denoted by D1, and the thickness of the impregnation member 202 in a state where the impregnation member 202 is not in contact with the fixing belt 102 is denoted by t (see FIG. 5). At this time, t is equal to or larger than D1, and D1 is equal to or larger than 0.

Further, the distance between an edge (a portion that is closest to the fixing belt 102) of the tip portion 212A of the front side support portion 204C and the fixing belt 102 in the vertical direction of the fixing belt 102 is denoted by D2 (see FIG. 5). At this time, D2 is equal to or larger than 0. In the present exemplary embodiment, D1 is larger than D2.

Further, in a state where the impregnation member 202 is not in contact with the fixing belt 102, the length of the impregnation member 202 extending from the tip portion 212A of the front side support portion 204C is denoted by L1 (see FIG. 6). At this time, L1 is equal to or larger than t (that is, equal to or larger than D1). Therefore, as illustrated in FIG. 6, the end portion 202A of the impregnation member 202 is in contact with the fixing belt 102 in a state of being curved in a convex shape from the tip portion 210A of the rear side support portion 204A.

In the above-described liquid applying device 200, t is equal to or larger than D1, and D1 is equal to or larger than 0. As a result, in the liquid applying device 200, as compared with a configuration in which t is smaller than D1, the contact between the impregnation member 202 and the fixing belt 102 is maintained even when the end portion 202A of the impregnation member 202 is collapsed. Further, in the liquid applying device 200, as compared with a configuration in which D1 is smaller than 0, the interference between the rear side support portion 204A and the fixing belt 102 is prevented.

Further, in the liquid applying device 200, D2 is equal to or larger than 0. As a result, in the liquid applying device 200, as compared with a configuration in which D2 is smaller than 0, the interference between the front side support portion 204C and the fixing belt 102 is prevented.

Further, in the liquid applying device 200, L1 is equal to or larger than t. Therefore, the end portion 202A of the impregnation member 202 is easily curved in a convex shape from the tip portion 210A of the rear side support portion 204A along the fixing belt 102. As a result, in the liquid applying device 200, as compared with a configuration in which L1 is smaller than t, the contact area between the impregnation member 202 and the fixing belt 102 is secured even when the impregnation member 202 is deformed due to the stress of the fixing belt 102.

Further, in the liquid applying device 200, the end portion 202A of the impregnation member 202 is in contact with the fixing belt 102 in a state of being curved in a convex shape from the tip portion 210A of the rear side support portion 204A. As a result, in the liquid applying device 200, as compared with a configuration in which the impregnation member is in contact with the circulation member while being straight from the tip of the rear side support portion, the contact between the impregnation member 202 and the fixing belt 102 is stabilized.

In the present exemplary embodiment, although D1 is larger than D2, D2 may be larger than D1 in order to stabilize the shape of the end portion 202A of the impregnation member 202 or the contact area with the fixing belt 102. Further, D1 may be equal to D2, in order to prevent the interference between the front side support portion 204C and the fixing belt 102, and between the rear side support portion 204A and the fixing belt 102.

Comparative Example

In Example 1 and Comparative Examples 1 to 3, a discharged amount of oil is measured using a liquid applying device in which the distance D1 between the edge of the tip portion 210A of the rear side support portion 204A and the fixing belt 102 in the vertical direction of the fixing belt 102, and the length L1 of the impregnation member 202 protruding from the tip portion 212A of the front side support portion 204C are changed. In Example 1 and Comparative Examples 1 to 3, in the fixing device using the liquid applying device, the fixing belt 102 that is in contact with the impregnation member 202 is driven by 300 km, and the discharged amount of the oil is measured at 100 km and 300 km. The discharged amount is calculated from the mass change of the impregnation member 202. Further, in Example 1 and Comparative Examples 1 to 3, the thickness t of the impregnation member 202 is 2.0 mm.

In Example 1, it is assumed that the distance D1 is 2.0 mm, the length L1 is 4.2 mm, and the thickness t is equal to or larger than the distance D1, and the distance D1 is larger than 0.

In Comparative Example 1, it is assumed that the distance D1 is 2.5 mm, the length L1 is 4.2 mm, and the thickness t is smaller than the distance D1. Further, in Comparative Example 2, it is assumed that the distance D1 is 3.0 mm, the length L1 is 5.7 mm, and the thickness t is smaller than the distance D1. Further, in Comparative Example 3, it is assumed that the distance D1 is 3.5 mm, the length L1 is 5.7 mm, and the thickness t is smaller than the distance D1.

Figure 7:
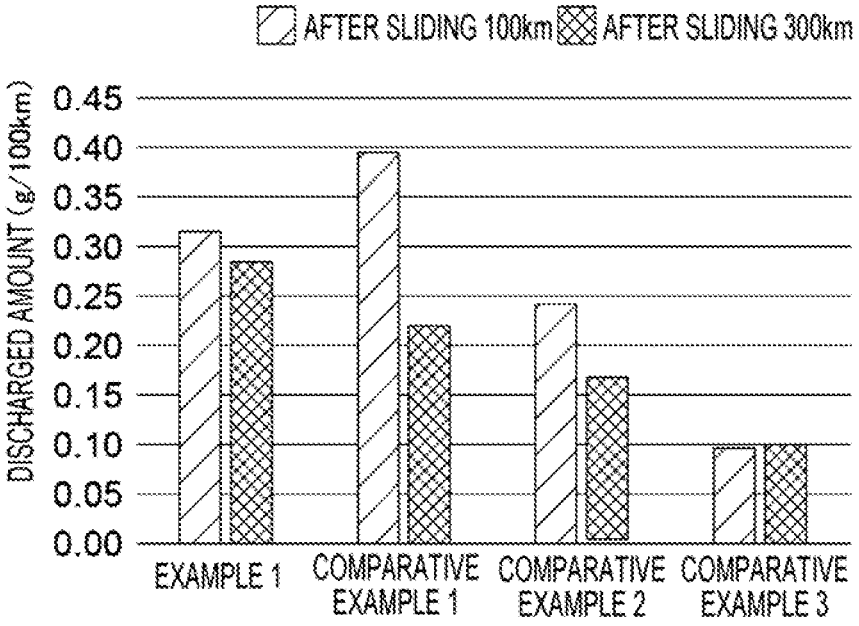
FIG. 7 is a graph comparing a discharged amount of oil after the impregnation member is slid by a predetermined distance on the fixing belt, in a liquid applying device of Example 1, and a liquid applying device of Comparative Examples 1 to 3.

In FIG. 7, in Example 1 and Comparative Examples 1 to 3, the measurement results of the discharged amount of the oil at the time when the fixing belt 102 that is in contact with the impregnation member 202 is slid by 100 km and 300 km are illustrated. As illustrated in FIG. 7, in Comparative Examples 1 to 3, the contact pressure between the impregnation member and the fixing belt is secured by providing the rear side support portion, and the discharged amount of the oil at the point of 100 km and 300 km is increased. However, the discharged amount of the oil at the point of 300 km is largely decreased as compared with Example 1. It may be presumably considered that the contact pressure between the impregnation member and the fixing belt is decreased due to the plastic deformation of the impregnation member at the point of 300 km, and thus the discharged amount of the oil is decreased.

Meanwhile, in Example 1, there is no significant change in the discharged amount of the oil at the point of 100 km and 300 km, and it may be seen that the oil is stably supplied to the fixing belt 102.

[Supplementary Explanation]

In the liquid applying devices 150 and 170 according to the first and second exemplary embodiments, the support members 156 and 172 are provided in plural along the width direction of the fixing belt 102. However, the present disclosure is not limited thereto, and the support member may be implemented by one support member.

In the liquid applying devices 150 and 170 according to the first and second exemplary embodiments, the thickness of the support members 156 and 172 is larger at the end portions in the width direction of the fixing belt 102 than that at the central portion in the width direction of the fixing belt 102. However, the present disclosure is not limited thereto, and the thickness of the support may be constant.

In the liquid applying device 200 according to the third exemplary embodiment, the support member 204 is provided with the front side support portion 204C. However, the present disclosure is not limited thereto, and the front side support portion may not be provided.

In the liquid applying devices 150, 170, and 200 according to the first to third exemplary embodiments, the impregnation members 152 and 202 are in contact with the fixing belt 102. However, the present disclosure is not limited thereto, and the impregnation members 152 and 202 may be in contact with the fixing roller.

Further, in the liquid applying devices 150, 170, and 200 according to the first to third exemplary embodiments, oil is applied, but a liquid (for example, water, grease, or the like) other than oil may be used. The oil or the grease may be heat-resistant. For example, silicone oil, fluorine-based oil, or the like is used as the oil, and silicone grease, fluorine-based grease, or the like is used as the grease.

Further, the configuration of the fixing device in which the liquid applying devices 150, 170, and 200 according to the first to third exemplary embodiments are used may be changed. Further, the liquid applying devices 150, 170, and 200 according to the first to third exemplary embodiments may be used for components of the image forming apparatus other than the fixing device. For example, the liquid applying devices 150, 170, and 200 according to the first to third exemplary embodiments may be used for the transfer belt, the transfer roller, or the like.

Further, the liquid applying device according to the respective exemplary embodiments may be applied to the heating device other than the fixing device. For example, the present disclosure may be applied to a thermo-compression device configured to thermally compress a sheet and a film with a roller and a belt. Further, the present disclosure may be applied to a drying device configured to dry a sheet with a roller and a belt. That is, the present disclosure may be applied a device other than the image forming apparatus.

Further, when a device has a configuration in which a liquid applying device and an applying-target object move relatively to each other, the present disclosure may be applied without being limited to a belt or a roller.

Although the present disclosure has been described in detail with respect to particular exemplary embodiments, it is obvious to those skilled in the art that the present disclosure is not limited to such exemplary embodiments, and that various other exemplary embodiments are possible within the scope of the present disclosure.

The foregoing description of the exemplary embodiments of the present disclosure has been provided for the purposes of illustration and description. It is not intended to be exhaustive or to limit the disclosure to the precise forms disclosed. Obviously, many modifications and variations will be apparent to practitioners skilled in the art. The embodiments were chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. A liquid applying device comprising:

a circulation member configured to circulate in a predetermined direction;

an impregnation member formed in a plate shape, the impregnation member being impregnated with a liquid, the impregnation member being in contact with the circulation member at an end portion thereof in a direction intersecting with a circulating direction of the circulation member so as to apply the liquid to the circulation member;

a housing that supports the impregnation member; and a support member that supports a portion including an end portion side of the impregnation member, at an opposite side of the circulation member in a state where the end portion of the impregnation member is in contact with the circulation member, wherein both the impregnation member and the support member protrude from the housing toward the circulation member; and wherein the support member is outside the impregnation member.

2. The liquid applying device according to claim 1, wherein the circulation member comprises an endless type belt, wherein the impregnation member is in contact with an inner surface of the belt, and wherein the liquid applying device further comprises:

a rotating body that is in contact with an outer surface of the belt while rotating, so as to circulate the belt; and a pressing unit provided inside the belt, the pressing unit being configured to press the belt against the rotating body without rotating.

3. A heating device comprising:

the liquid applying device according to claim 2; and a heating member configured to heat the circulation member, wherein the rotating body is configured to rotate and transport a sheet-shaped medium with nipping the sheet-shaped medium with the circulation member, and wherein the sheet-shaped medium is transported between the circulation member and the rotating body, and the sheet-shaped medium is heated.

4. The liquid applying device according to claim 1, wherein the liquid comprises oil.

5. The liquid applying device according to claim 1, wherein the support member is provided in a housing so as to be elastically deformable, the housing holding the impregnation member, and wherein the support member presses the end portion of the impregnation member against the circulation member by applying pressure from the opposite side of the circulation member in an elastically deformed state.

6. The liquid applying device according to claim 5, wherein the support member comprises a leaf spring.

7. The liquid applying device according to claim 6, wherein a pressing direction in which the impregnation member is pressed against the circulation member is oblique with respect to a surface of the circulation member, and wherein an end portion of the support member protrudes in the circulating direction of the circulation member from the end portion of the impregnation member.

8. The liquid applying device according to claim 5, wherein a pressing force with which the end portion of the impregnation member is pressed against the circulation member by the support member is different in a width direction intersecting with the circulating direction of the circulation member.

9. The liquid applying device according to claim 8, wherein the pressing force with which the end portion of the impregnation member is pressed against the circulation member by the support member is stronger at end portions in the width direction of the circulation member than that at a central portion in the width direction of the circulation member.

10. The liquid applying device according to claim 9, wherein a thickness of the support member is greater at the end portions in the width direction of the circulation member than that at the central portion in the width direction of the circulation member.

11. The liquid applying device according to claim 8, wherein a plurality of the support members is provided in the width direction of the circulation member.

12. The liquid applying device according to claim 8, wherein a thickness of the support member is different in the width direction of the circulation member.

13. The liquid applying device according to claim 1, wherein the support member comprises a support portion that supports an opposite side of the impregnation member to the circulation member, and t is equal to or larger than D1, and D1 is 0 or more, where D1 is a distance between a tip of the support portion and the circulation member, and t is a thickness of the impregnation member in a state where the impregnation member is not in contact with the circulation member.

14. The liquid applying device according to claim 13, wherein the support member comprises another support portion that supports a side of the impregnation member where the impregnation member faces the circulation member, and wherein D2 is 0 or more, where D2 is a distance between a tip of the another support portion and the circulation member.

15. The liquid applying device according to claim 14, wherein D1 and D2 are equal to each other.

16. The liquid applying device according to claim 13, wherein L1 is equal to or larger than t, where L1 is a length of the impregnation member from the tip of the support portion.

17. The liquid applying device according to claim 16, wherein the impregnation member comes in contact with the circulation member in a state of being curved in a convex shape from the tip of the support portion.

18. A heating device comprising:

the liquid applying device according to claim 1;

a heating member configured to heat the circulation member; and a rotating body configured to rotate and transport a sheet-shape medium while nipping the sheet-shaped medium with the circulation member, wherein the sheet-shaped medium is transported between the circulation member and the rotating body, and the sheet-shaped medium is heated.

19. The liquid applying device according to claim 1, wherein both the impregnation member and the support member are bent in an obtuse angle toward the circulation member.

20. A liquid applying device comprising:

a circulation means for circulating in a predetermined direction;

an impregnation means formed in a plate shape, the impregnation means being impregnated with a liquid, the impregnation means being in contact with the circulation means at an end portion thereof in a direction intersecting with a circulating direction of the circulation means so as to apply the liquid to the circulation means;

a housing means for supporting the impregnation means; and a support means that supports a portion including an end portion side of the impregnation means, at an opposite side of the circulation means in a state where the end portion of the impregnation means is in contact with the circulation means, wherein both the impregnation means and the support means protrude from the housing toward the circulation member; and wherein the support member is outside the impregnation member.

21. A liquid applying device comprising:

a circulation member configured to circulate in a predetermined direction;

an impregnation member formed in a plate shape, the impregnation member being impregnated with a liquid, the impregnation member being in contact with the circulation member at an end portion thereof in a direction intersecting with a circulating direction of the circulation member so as to apply the liquid to the circulation member; and a support member that supports a portion including an end portion side of the impregnation member, at an opposite side of the circulation member in a state where the end portion of the impregnation member is in contact with the circulation member, wherein a pressing force with which the end portion of the impregnation member is pressed against the circulation member by the support member is different in a width direction intersecting with the circulating direction of the circulation member.

* * * * *